US010689761B2

(12) United States Patent
Ohnishi

(10) Patent No.: US 10,689,761 B2
(45) Date of Patent: Jun. 23, 2020

(54) PLATING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/024,913

(22) Filed: Jul. 2, 2018

(65) Prior Publication Data

US 2019/0017173 A1 Jan. 17, 2019

(30) Foreign Application Priority Data

Jul. 14, 2017 (JP) ..... 2017-138475

(51) Int. Cl.

| | |
|---|---|
| ***C23C 18/16*** | (2006.01) |
| ***C23C 18/18*** | (2006.01) |
| ***C23C 18/20*** | (2006.01) |
| ***C23C 18/22*** | (2006.01) |

(52) U.S. Cl.

CPC ..... *C23C 18/1605* (2013.01); *C23C 18/18* (2013.01); *C23C 18/1893* (2013.01); *C23C 18/2086* (2013.01); *C23C 18/22* (2013.01)

(58) Field of Classification Search

CPC ..... C23C 18/1603; C23C 18/1605; C23C 18/1607; C23C 18/1608; C23C 18/161; C23C 18/1612

See application file for complete search history.

(56) References Cited

U.S. PATENT DOCUMENTS

| | | | | |
|---|---|---|---|---|
| 4,830,880 | A * | 5/1989 | Okubi | C23C 18/28 427/229 |
| 4,940,608 | A * | 7/1990 | Kawagishi | H05K 3/184 427/259 |
| 5,905,018 | A * | 5/1999 | Bhatt | H05K 3/184 427/304 |
| 2006/0257633 | A1 * | 11/2006 | Inoue | C23C 18/1605 428/195.1 |

FOREIGN PATENT DOCUMENTS

| | | |
|---|---|---|
| JP | 2007057749 | 3/2007 |
| JP | 2010098232 | 4/2010 |

* cited by examiner

*Primary Examiner* — Dah-Wei D. Yuan
*Assistant Examiner* — Nga Leung V Law
(74) *Attorney, Agent, or Firm* — JCIPRNET

(57) ABSTRACT

A plating method includes a first mask forming step of ejecting a UV-curable ink in the form of ink droplets from an inkjet head so as to have the ejected ink droplets land on a plating target object and to form a first plating mask on the plating target object, a catalyst applying step of applying a catalyst for deposition of plating material to the plating target object on which the first plating mask is formed, a second mask forming step of having the ink droplets land on the first plating mask so as to form a second plating mask on the first plating mask, a plating step of performing electroless plating to the plating target object subsequent to the second mask forming step, and a mask removing step of removing the first plating mask and the second plating mask from the plating target object subsequent to the plating step.

6 Claims, 6 Drawing Sheets

PLATING METHOD

CROSS REFERENCE TO RELATED APPLICATIONS

This application claims the priority benefit of Japanese Patent Application No. 2017-138475, filed on Jul. 14, 2017. The entirety of the above-mentioned patent application is hereby incorporated by reference herein and made a part of this specification.

TECHNICAL FIELD

This disclosure relates to a plating method for plating of a plating target object having a plating mask formed thereon by inkjet printing.

DESCRIPTION OF THE BACKGROUND ART

Among conventional plating methods for plating of a plating target object are such known methods in which a photoresist is patterned on a substrate by using a photomask, and electroless plating is performed with the patterned photoresist being used as mask so as to deposit plating material and thereby form a metal layer (for example, Japanese Unexamined Patent Publication No. 2007-57749).

In some other known methods, plating masks are respectively provided at both end sides of a base electrode layer formed on a substrate, and a plated electrode layer is formed by plating on the base electrode layer (for example, Japanese Unexamined Patent Publication No. 2010-98232). In this method, a resist material may be ejected by inkjet printing to form the plating masks.

[Patent Literature 1] Japanese Unexamined Patent Publication No. 2007-57749

[Patent Literature 2] Japanese Unexamined Patent Publication No. 2010-98232

SUMMARY

When the mask is formed by the method described in Japanese Unexamined Patent Publication No. 2007-57749, different devices may be used, for example, a coating applicator for applying the photoresist to the substrate, and an exposure device for patterning the photoresist using the photomask. This method, therefore, may increase facility costs. The mask formation by this method that requires applying the photoresist and exposure using the photomask may be a rather complicated process. This may be a bottleneck in improvements of workability.

In the method described in Japanese Unexamined Patent Publication No. 2010-98232, when the substrate having the plating mask formed thereon is plated by, for example, electroless plating, a catalyst for deposition of plating material is applied in advance to the substrate including the plating mask. The catalyst-applied substrate is then immersed in a plating solution to be plated. Then, the plating mask is removed. In the method described in Japanese Unexamined Patent Publication No. 2010-98232, the plating mask is expected to serve two purposes; preventing the catalyst from attaching to the substrate (medium 1), and preventing the catalyst from attaching to the plating mask itself. In case the plating mask is formed by inkjet printing in the method described in Japanese Unexamined Patent Publication No. 2010-98232, such a material may desirably be used that can be ejected by inkjet printing and to which the catalyst is attachable. It may be necessary to prepare particular inks for inkjet printing that can prevent the catalyst from attaching to the plating mask. This may narrow a range of material options, possibly making the mask formation difficult to perform. Thus, the method described in Japanese Unexamined Patent Publication No. 2010-98232 may have difficulty in forming the plating mask using the multipurpose inks conventionally available for inkjet printing.

To address the issue, this disclosure provides a plating method that may enable adequate removal of a plating mask when the plating mask is formed by inkjet printing.

A plating method disclosed herein includes: a first mask forming step of ejecting a UV-curable ink in the form of ink droplets from an inkjet head so as to have the ejected ink droplets land on a plating target object and to form a first plating mask on the plating target object, the first plating mask being formed to prevent a catalyst for deposition of plating material from attaching to the plating target object; a catalyst applying step of applying the catalyst to the plating target object having the first plating mask formed thereon; a second mask forming step of having the ink droplets land on the first plating mask so as to form a second plating mask on the first plating mask; a plating step of performing electroless plating to the plating target object subsequent to the second mask forming step; and a mask removing step of removing the first plating mask and the second plating mask from the plating target object subsequent to the plating step.

According to this configuration, the catalyst applied to the first plating mask may be coated with the second plating mask formed on the first plating mask. This may prevent the plating material from depositing on the first and second plating masks. Thus, even when the plating masks are removed by using, for example, a solvent, since possible formation of a plating layer on either one of the plating masks may be avoided, the solvent may adequately penetrate into the plating masks and allow the plating masks to be both successfully removed.

Another plating method disclosed herein includes: a catalyst applying step of applying a catalyst for deposition of plating material to a plating target object; a mask forming step of ejecting a UV-curable ink in the form of ink droplets from an inkjet head so as to have the ejected ink droplets land on the plating target object and to form a plating mask on the plating target object; a plating step of performing plating to the plating target object subsequent to the mask forming step; and a mask removing step of removing the plating mask from the plating target object subsequent to the plating step.

According to this configuration, the plating mask is formed on the catalyst-applied plating target object, so that the catalyst is coated with the plating mask. This may prevent the plating material from depositing on the plating mask. Thus, even when the plating masks are removed by using, for example, a solvent, since possible formation of a plating layer on the plating mask may be avoided, the solvent may adequately penetrate into the plating mask and allow the plating mask to be successfully removed.

The UV-curable ink may be a UV-curable and solvent-soluble ink including a UV-curable compound polymerizable by ultraviolet irradiation into a UV-curable resin, and a solvent-soluble material soluble in a solvent.

According to this configuration, the plating masks may be readily soluble in the solvent. This may facilitate removal of the plating mask using the solvent.

The UV-curable ink may preferably be a SUV-curable and solvent-soluble ink. The SUV-curable and solvent-soluble ink is the UV-curable and solvent-soluble ink further including an organic solvent having compatibility with the UV-curable compound.

According to this configuration, the plating masks may be more readily soluble in the solvent. This may further facilitate removal of the plating mask using the solvent.

The plating method may preferably further include a surface roughening step of subjecting the plating target object to a surface roughening treatment prior to the catalyst applying step.

According to this configuration, roughening the surface of the plating target object may increase an area of contact between the catalyst and the plating target object, allowing the catalyst to be easily applied to the plating target object.

Preferably, the catalyst applying step may be a wet process, and the plating step may also be a wet process.

According to this configuration, the wet process employed as the catalyst applying step may allow the catalyst to be easily applied to the plating target object by immersing the plating target object in a bath containing an aqueous solution for catalyst loading. Similarly, the wet process employed as the plating step may allow easy plating of the plating target object by immersing the plating target object in a bath containing an electroless plating solution.

DETAILED DESCRIPTION OF EMBODIMENTS

Hereinafter, embodiments of this disclosure are described in detail referring to the accompanying drawings. It should be understood that none of the technical aspects disclosed herein is limited by the embodiments. Structural and technical elements described in the embodiments below may include elements that are replaceable and easily feasible by those skilled in the art and elements that are substantially identical. The scope of this disclosure encompasses suitable combinations of the embodiments and the structural and technical elements described therein.

First Embodiment

In a plating method according to a first embodiment, a plating mask is formed by inkjet printing on a plating target object, and the plating mask is removed after plating of the plating target object having the plating mask formed thereon is completed. The plating method is hereinafter described referring to FIGS. 1 and 2.

Figure 1:
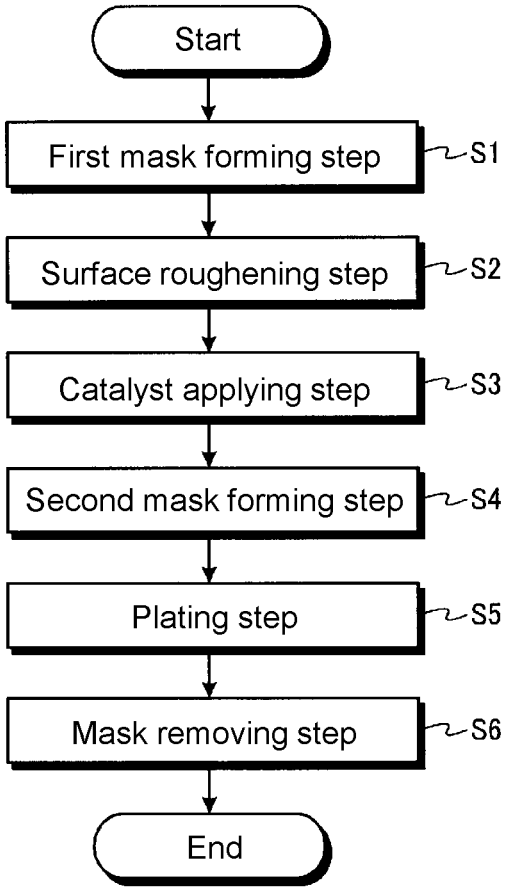
FIG. 1 is a flow chart of a plating method according to a first embodiment.
Figure 2:
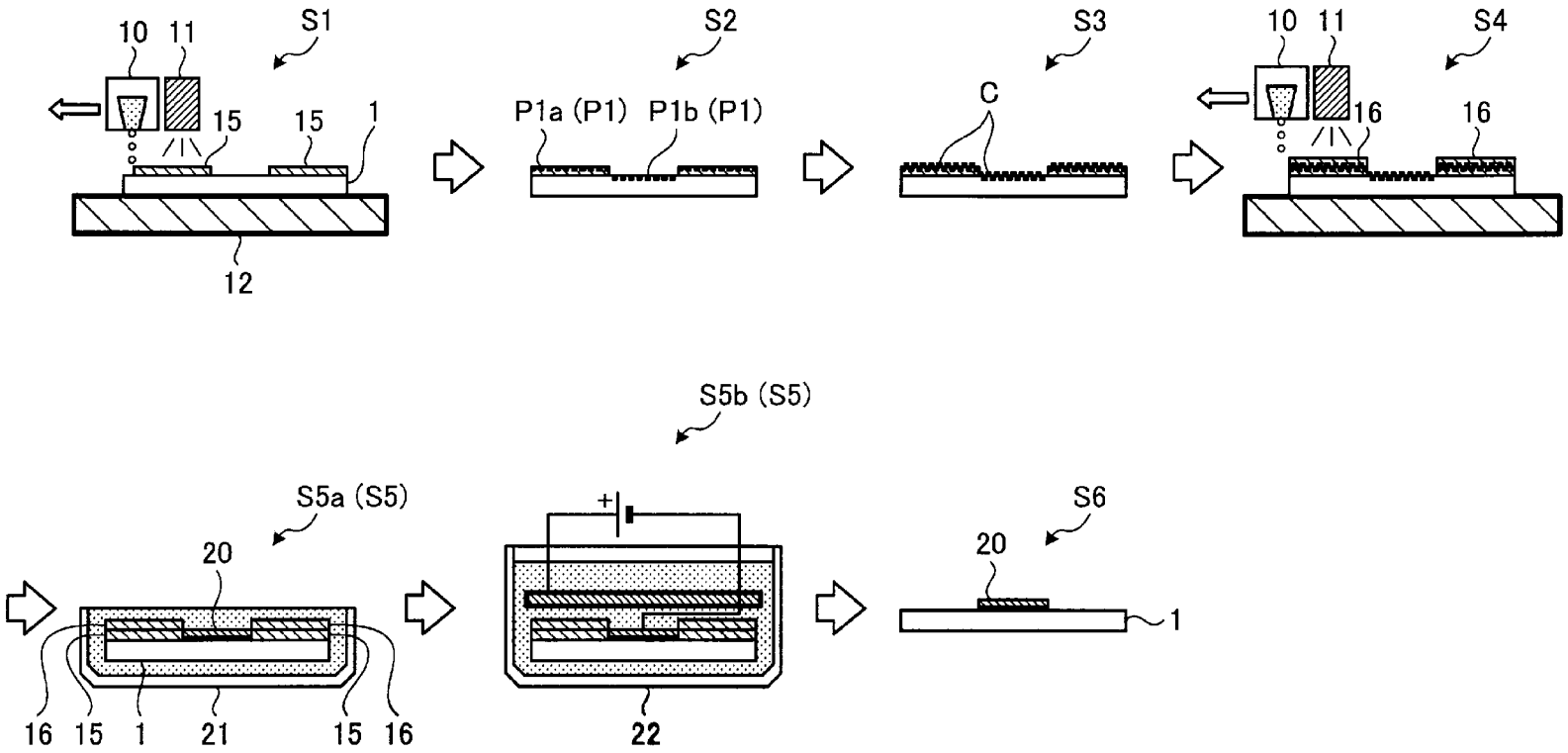
FIG. 2 is a drawing that illustrates the plating method according to the first embodiment.

FIG. 1 is a flow chart of the plating method according to the first embodiment. FIG. 2 is a drawing that illustrates the plating method according to the first embodiment.

To start with, a plating target object 1 is described prior to description of the plating method. Exemplified materials of the plating target object 1 may include resins, metals, and glass. Any of such materials that can be plated may be selected for the plating target object 1. The plating target object 1 may have any shape that allows this object to be plated. For example, the object 1 may be a plate-shaped object or a three-dimensional object with a curved surface(s). In the description below, the plating target object 1 is a medium made of a resin such as a card.

As illustrated in FIGS. 1 and 2, the plating method according to the first embodiment may include a first mask forming step S1, a surface roughening step S2, a catalyst applying step S3, a second mask forming step S4, a plating step S5, and a mask removing step S6, which are carried out in the mentioned order. The plating method according to the first embodiment may or may not include the surface roughening step S2. The plating target object 1 is subjected in advance to a pretreatment, for example, cleaning.

The first mask forming step S1 is a step of ejecting a UV-curable ink in the form of ink droplets from an inkjet head 10 so as to have the ink droplets land on the plating target object 1 and to form a first plating mask 15 on the plating target object 1. The first plating mask 15 serves to prevent a catalyst for deposition of plating material from attaching to the plating target object 1.

Next, the UV-curable ink used in the first mask forming step S1 according to the first embodiment is described. In the first embodiment, the UV-curable ink used is a UV-curable and solvent-soluble ink that is easily removable in the mask removing step S6 described later. Specifically, the UV-curable ink includes a UV-curable compound polymerizable into a UV-curable resin, and a solvent-soluble material. This ink is insoluble in an aqueous solution but is soluble in an organic solvent. An electroless plating solution used in the plating step S5 described later is an aqueous solution. Therefore, the water-insoluble, UV-curable ink is used, so that the first plating mask 15 is not dissolved in the aqueous solution during the plating. The UV-curable compound includes, for example, a monomer such as acrylic ester, and an initiator. The solvent-soluble material may be a butyral resin. The weight ratio of the solvent-soluble material to the UV-curable compound may be greater than or equal to 20% and less than or equal to 70%. An appropriate amount of alcohol less than in weight than the UV-curable compound may be added to the UV-curable ink to adjust its viscosity to an extent that allows the UV-curable ink to be ejected from the inkjet head 10. When the UV-curable ink is irradiated with ultraviolet light, the initiator is activated and reacted with the monomer, and the UV-curable ink is consequently cured.

In the first mask forming step S1, the plating target object 1 is set on a table 12, as illustrated in FIG. 2. In the first mask forming step S1, while the inkjet head 10 is moved in main and sub scanning directions relative to the plating target object 1 set on the table 12, the ink droplets are ejected to the plating target object 1 so as to form a predetermined pattern. One surface of the plating target object 1 (upper surface illustrated in FIG. 2) is a plating target surface on which a plating layer 20 and a first plating mask 15 will be formed. In the first mask forming step S1, the ink droplets ejected to and dropped on the surface of the plating target object 1 are irradiated with ultraviolet light emitted from an ultraviolet irradiator 11 so as to cure the UV-curable ink. As a result, the first plating mask 15 is formed on the surface. The table 12 may be replaced with a platen heater. In case the platen heater is used, the plating target object 1 may be heated by the platen heater.

In the surface roughening step S2, a surface P1 of the plating target object 1 having the first plating mask 15 formed thereon is roughened. In the surface roughening step S2, the surface P1 of the plating target object 1 is etched with, for example, an etching solution to generate irregularity on the surface P1 for surface modification. Specifically, a surface P1*a* of the first plating mask 15 and a surface P1*b* of the plating target object 1 on which the first plating mask 15 is unformed are roughened in the surface roughening step S2. The etching solution is selected from any solutions that are appropriate for the plating target object 1. In the surface roughening step S2, the surface P1 of the plating target object 1 may be, for example, sandblasted to generate irregularity on the surface P1 for surface modification. In the surface roughening step S2, the surface P1 of the plating target object 1 is thus roughened to improve the strength of plating adhesion.

In the catalyst applying step S3, a catalyst C is applied to the roughened surface of the plating target object 1. The catalyst C serves to facilitate deposition of plating material in the plating step S5 subsequently performed. The first embodiment that employs electroless plating includes the catalyst applying step S3. In the catalyst applying step S3, the catalyst C is applied to the surface P1*a* of the first plating mask 15 and the surface P1*b* of the plating target object 1 on which the first plating mask 15 is unformed. In the catalyst applying step S3, the plating target object 1 is immersed in two aqueous solutions one after the other; a stannous chloride-containing aqueous solution, and a palladium chloride-containing aqueous solution, so as to absorb the catalyst $Sn^{2+}$–$Pd^{2+}$ to the plating target object 1. Then, $Sn^{2+}$ is removed, and Pd (palladium) is deposited on the plating target object 1. Thus, the catalyst applying step S3 is a wet process.

The second mask forming step S4 is a step of ejecting from the inkjet head 10 a UV-curable ink similar to the ink used in the first mask forming step S1 in the form of ink droplets and having the ejected ink droplets land on the first plating mask 15 so as to form a second plating mask 16 on the first plating mask 15.

In the second mask forming step S4, the plating target object 1 to which catalyst C has been applied is set on the table 12, as illustrated in FIG. 2. In the second mask forming step S4, while the inkjet head 10 is moved in the main and sub scanning directions relative to the plating target object 1 set on the table 12, the ink droplets are ejected to the first plating mask 15 on the plating target object 1 so as to form a predetermined pattern. In the second mask forming step S4, the ink droplets ejected to and dropped on the first plating mask 15 formed on the plating target object 1 are irradiated with ultraviolet light emitted from the ultraviolet irradiator 11 so as to cure the UV-curable ink. As a result, the second plating mask 16 is formed on the first plating mask 15. In the second mask forming step S4, the second plating mask 16 is formed in the same region that the first plating mask 15 is formed. The region where the second plating mask 16 is formed is not necessarily limited to exactly the same region as the first plating mask 15. The second plating mask 16 may be formed in a smaller or larger region than that of the first plating mask 15.

By performing the second mask forming step S4, the catalyst C applied on the first plating mask 15 is coated with the second plating mask 16 formed on the first plating mask 15. The catalyst C may be accordingly left unexposed.

The plating step S5 performs plating to the plating target object 1 to which the catalyst C has been applied. In the plating step S5, an electroless plating step S5*a* is performed for the plating target object 1. In the electroless plating step S5*a*, the plating target object 1 is electrolessly plated by being immersed for a predetermined period of time in an electroless plating solution kept at a predetermined temperature in an electroless plating bath 21. In the electroless plating step S5*a*, the plating layer 20 is formed on the surface P1*b* of the plating target object 1 on which neither of the first plating mask 15 nor the second plating mask 16 is formed. Optionally, particles of diamond or titanium oxide may be added to the electroless plating solution, or the electroless plating step S5*a* may be repeatedly performed.

As illustrated in FIG. 2, the plating method may include an electric plating step S5*b* in addition to the electroless plating step S5*a*. In the electric plating step S5*b*, the plating target object 1 is electrically plated by being immersed in a plating solution in an electric plating bath 22, with the electrolessly-plated target surface of the plating target object 1 being used as anode. This additional step may increase the plating layer 20 in thickness. Thus, the plating step S5 is a wet process.

In the mask removing step S6, the first plating mask 15 and the second plating mask 16 formed on the plated target object 1 are removed. The solvent-soluble ink is used to form the first plating mask 15 and the second plating mask 16. In the mask removing step S6, therefore, the first plating mask 15 and the second plating mask 16 may be dissolved and removed by, for example, being immersed in an organic solvent such as alcohol. As a result, the plating layer 20 alone remains on the plating target object 1.

After that, a cleaning and fixing step, though not illustrated in the drawing, may be further performed. In the cleaning and fixing step, the plating target object 1 is cleaned after the first and second plating masks 15 and 16 are removed, and then set in a heating chamber and heated, so that the plating layer 20 is fixed on the plating target object 1.

Thus, the first plating mask 15 serves as masking that allows the plating layer 20 to be formed on the plating target object 1. On the other hand, the second plating mask 16 serves as masking that prevents the first plating mask 15 from being plated.

According to the first embodiment, the catalyst C applied to the first plating mask 15 may be coated with the second plating mask 16 formed on the first plating mask 15. This may prevent the plating material from depositing on the first and second plating masks 15 and 16. Thus, even when in the mask removing step S6, the plating masks 15 and 16 are removed by using an organic solvent, the organic solvent may adequately penetrate into the plating masks 15 and 16 because formation of the plating layer 20 on the plating masks 15 and 16 is preventable as described. This may facilitate adequate removal of the plating masks 15 and 16. The plating mask 15 to which the catalyst C has been applied is coated with the plating mask 16, so that the plating layer 20 is formed on neither of the plating mask 15 nor the plating mask 16. Thus, formation of the plating layer 20 in the region of the plating masks may be avoided when the conventional multipurpose inks for inkjet printing are used to form the plating masks 15 and 16. This may broaden a range of options for usable inks.

According to the first embodiment, the UV-curable ink is a UV-curable and solvent-soluble ink including a UV-curable compound and a solvent-soluble material. Therefore, the plating masks 15 and 16 may be readily soluble in the organic solvent and thereby easily removable in the mask removing step S6.

According to the first embodiment, roughening the surface of the plating target object 1 prior to the catalyst applying step S3 may increase an area of contact between the catalyst C and the plating target object 1, allowing the catalyst C to be easily applied to the plating target object 1.

While the UV-curable ink used in the first embodiment is the UV-curable and solvent-soluble ink, this ink may be replaced with a SUV-curable and solvent-soluble ink (hereinafter, SUV ink). The SUV ink is a UV-curable and solvent-soluble ink including a UV-curable compound and a solvent-soluble material and further including an organic solvent having compatibility with the UV-curable compound. The organic solvent may be, for example, cellosolve acetate having compatibility with acrylic acid ester as UV-curable compound, and a butyral resin as solvent-soluble material. Specifically, the SUV ink is prepared by adding, to a UV-curable compound having a degree of viscosity at 20° C. in the range of 10 to 100,000 mPa·sec, 20 wt. % to 70 wt. % of the solvent-soluble material to the total weight of the SUV ink, and 30 wt. % to 80 wt. % of the organic solvent to the total weight of the SUV ink. In the SUV ink, the weight ratios of the UV-curable compound, solvent-soluble material, and organic solvent are adjusted to amount in total to 100 wt. %. By thus using the SUV-curable and solvent-soluble ink as the UV-curable ink, the plating masks 15 and 16 may be readily soluble in the organic solvent and thereby easily removable in the mask removing step S6.

Second Embodiment

Figure 3:
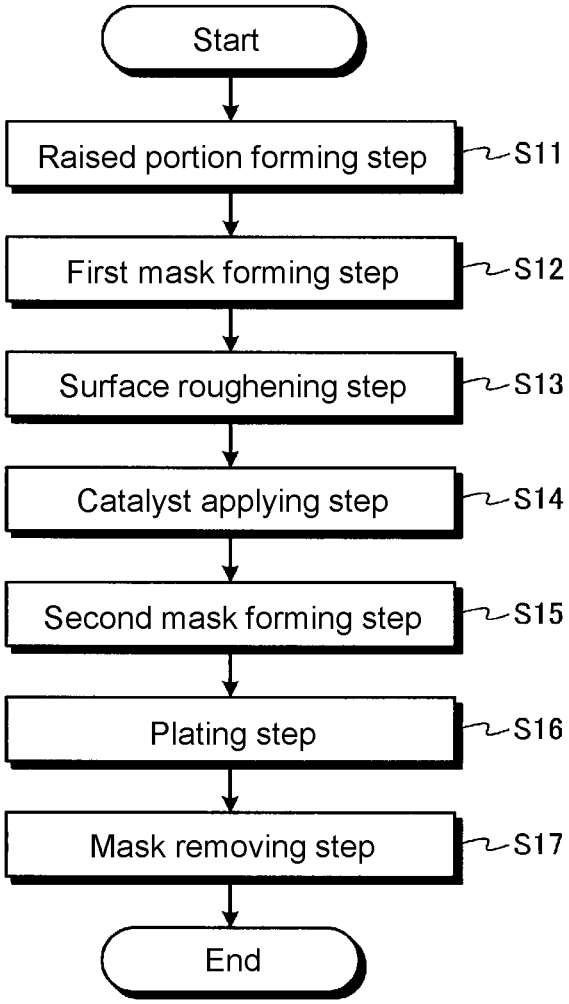
FIG. 3 is a flow chart of a plating method according to a second embodiment.
Figure 4:
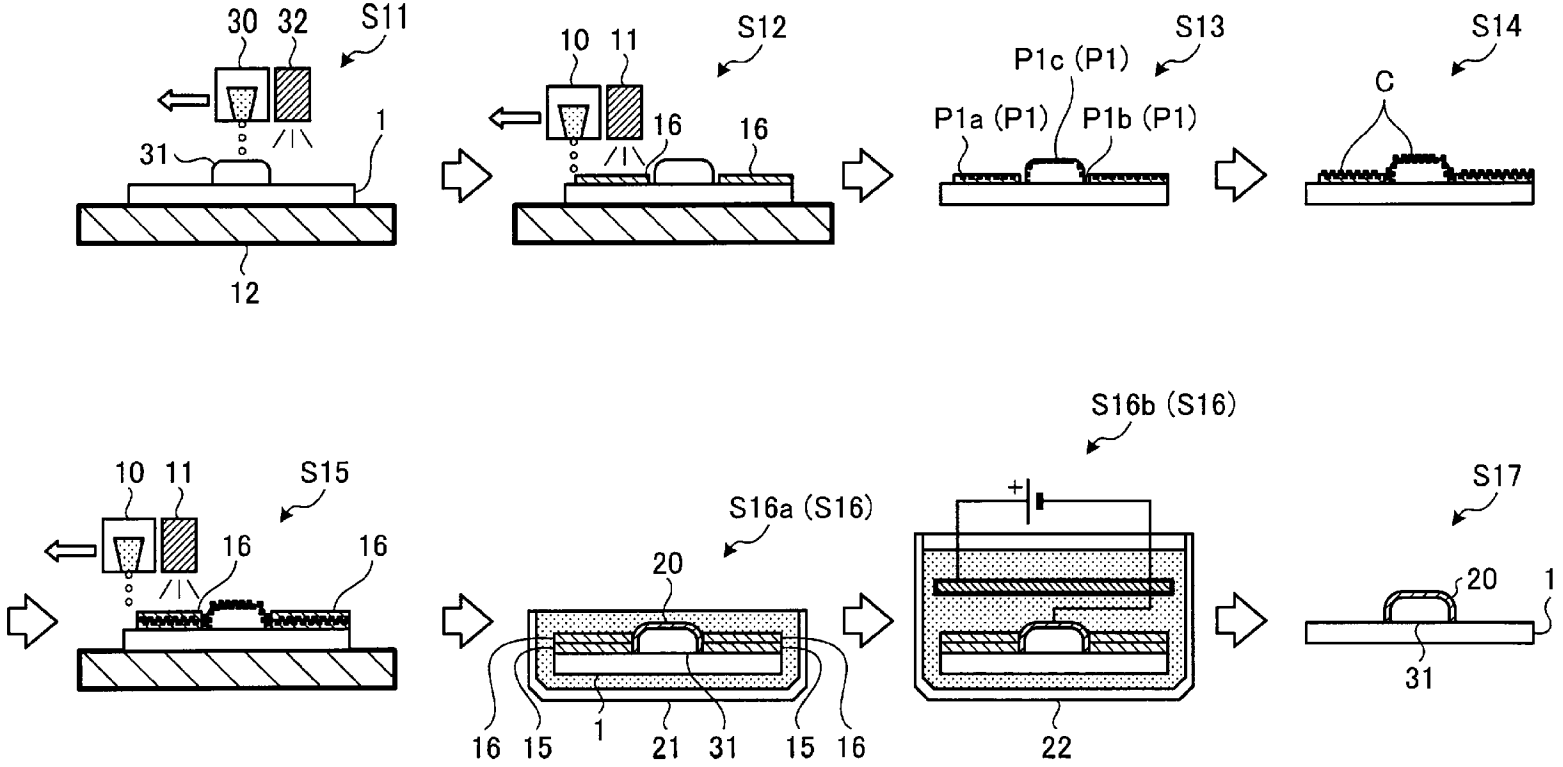
FIG. 4 is a drawing that illustrates the plating method according to the second embodiment.

A plating method according to a second embodiment is hereinafter described referring to FIGS. 3 and 4. The second embodiment describes any technical aspects distinct from the first embodiment to avoid redundancy in description, while illustrating elements similar to those of the first embodiment with the same reference signs. FIG. 3 is a flow chart of the plating method according to the second embodiment. FIG. 4 is a drawing that illustrates the plating method according to the second embodiment.

The plating method according to the second embodiment may include a raised portion forming step S11, a first mask forming step S12, a surface roughening step S13, a catalyst applying step S14, a second mask forming step S15, a plating step S16 (an electroless plating step S16*a*, an electric plating step S16*b*), and a mask removing step S17, which are carried out in the mentioned order. The plating method according to the second embodiment may or may not include the surface roughening step S13. A plating target object 1 is similar to the one used in the first embodiment and is subjected in advance to a pretreatment, for example, cleaning.

The raised portion forming step S11 is a step of ejecting a UV-curable ink in the form of ink droplets from an inkjet head 30 so as to have the ink droplets land on the plating target object 1, and curing the ejected UV-curable ink by ultraviolet irradiation so as to form a raised portion 31 on the plating target object 1.

Next, the UV-curable ink used in the raised portion forming step S11 according to the second embodiment is described. The UV-curable ink used in the second embodiment is a UV-curable and insoluble ink. This ink is insoluble in a plating solution used in the plating step S16, insoluble in an aqueous solution used in the catalyst applying step S14, and insoluble in an organic solvent used in the mask removing step S17. The UV-curable ink includes a UV-curable compound polymerizable into a UV-curable resin. The UV-curable compound may at least include a monomer and an initiator. The UV-curable ink may include a coloring material so as to produce the same color as the plating target object 1. When the UV-curable ink is irradiated with ultraviolet light, the initiator is activated and reacted with the monomer, and the UV-curable ink is consequently cured.

In the raised portion forming step S11, the plating target object 1 is set on the table 12, as illustrated in FIG. 4. In the raised portion forming step S11, while the inkjet head 30 is moved in the main and sub scanning directions relative to the plating target object 1 set on the table 12, the ink droplets are ejected to the plating target object 1 so as to form a predetermined pattern (raised image). In the raised portion forming step S11, the raised image formed with the UV-curable ink is cured by being irradiated with ultraviolet light emitted from an ultraviolet irradiator 32 so as to form the raised portion 31.

The first mask forming step S12 is similar to the first mask forming step S1 according to the first embodiment. This is a step of ejecting the UV-curable and solvent-soluble ink in the form of ink droplets from the inkjet head 10 so as to have the ink droplets land on the plating target object 1 and to form the first plating mask 15 on the plating target object 1.

In the first mask forming step S12, the first plating mask 15 is formed in adjacency to an edge part of the raised portion 31 with a slight interval to the edge part (interface between the raised portion 31 and the plating target object 1), as illustrated in FIG. 4. The first plating mask 15 is thus formed to ensure that the whole raised portion 31 including its edge part is plated in the plating step S16.

In the surface roughening step S13, a surface P1 of the plating target object 1 having the raised portion 31 and the first plating mask 15 formed thereon is roughened. Specifically, a surface P1*c* of the raised portion 31, a surface P1*a* of the first plating mask 15, and a surface P1*b* of the plating target object 1 on which neither of the raised portion 31 nor the first plating mask 15 is formed are roughened in the surface roughening step S13. The surface roughening step S13 is similar to the surface roughening step S2 of the first embodiment, description of which is, therefore, omitted.

In the catalyst applying step S14, the catalyst C is applied to the roughened surface of the plating target object 1 having the raised portion 31 and the first plating mask 15 formed thereon. Specifically, in the catalyst applying step S14, the catalyst C is applied to the surface P1*c* of the raised portion 31, the surface P1*a* of the first plating mask 15, and the surface P1*b* of the plating target object 1 on which neither of the raised portion 31 nor the first plating mask 15 is formed. The catalyst applying step S14 is similar to the catalyst applying step S3 of the first embodiment, description of which is, therefore, omitted.

The second mask forming step S15 is a step of ejecting from the inkjet head 10 a UV-curable ink similar to the ink used in the first mask forming step S12 in the form of ink droplets so as to have the ink droplets land on the first plating mask 15 and to form a second plating mask 16 on the first plating mask 15. The second mask forming step S15 is similar to the second mask forming step S4 of the first embodiment, description of which is, therefore, omitted.

The plating step S16 performs plating to the plating target object 1 to which the catalyst C has been applied. In the mask removing step S17, the first plating mask 15 and the second plating mask 16 formed on the plated target object 1 are removed. The plating step S16 and the mask removing step S17 are similar to the plating step S5 and the mask removing step S6 of the first embodiment, description of which is, therefore, omitted. As a result of these steps, the raised portion 31 and the plating layer 20 formed on the surface P1*c* of the raised portion 31 remain on the resulting plating target object 1 after the mask removing step S17.

According to the second embodiment, the second plating mask 16 is formed on the first plating mask 15 as in the earlier embodiment, and the catalyst C applied to the first plating mask 15 may be coated with the second plating mask 16. This may prevent the plating material from depositing on the first and second plating masks 15 and 16. Thus, even when in the mask removing step S17, the plating masks 15 and 16 are removed by using an organic solvent, the organic solvent may adequately penetrate into the plating masks 15 and 16 because formation of the plating layer 20 on the plating masks 15 and 16 is preventable as described. This may facilitate adequate removal of the plating masks 15 and 16.

According to the second embodiment, the plating layer 20 may be formed on the surface P1*c* of the raised portion 31. This may provide improved decoration for the plated target object 1. In the raised portion 31 formable by inkjet printing, variously different images may be easily formed, and a variety of decorative plating options may be accordingly easily available.

Third Embodiment

Figure 5:
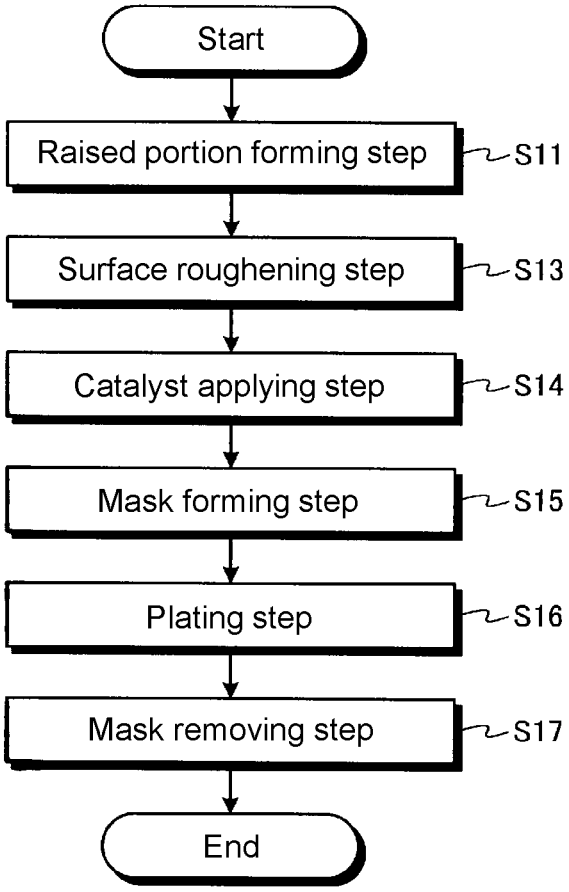
FIG. 5 is a flow chart of a plating method according to a third embodiment.
Figure 6:
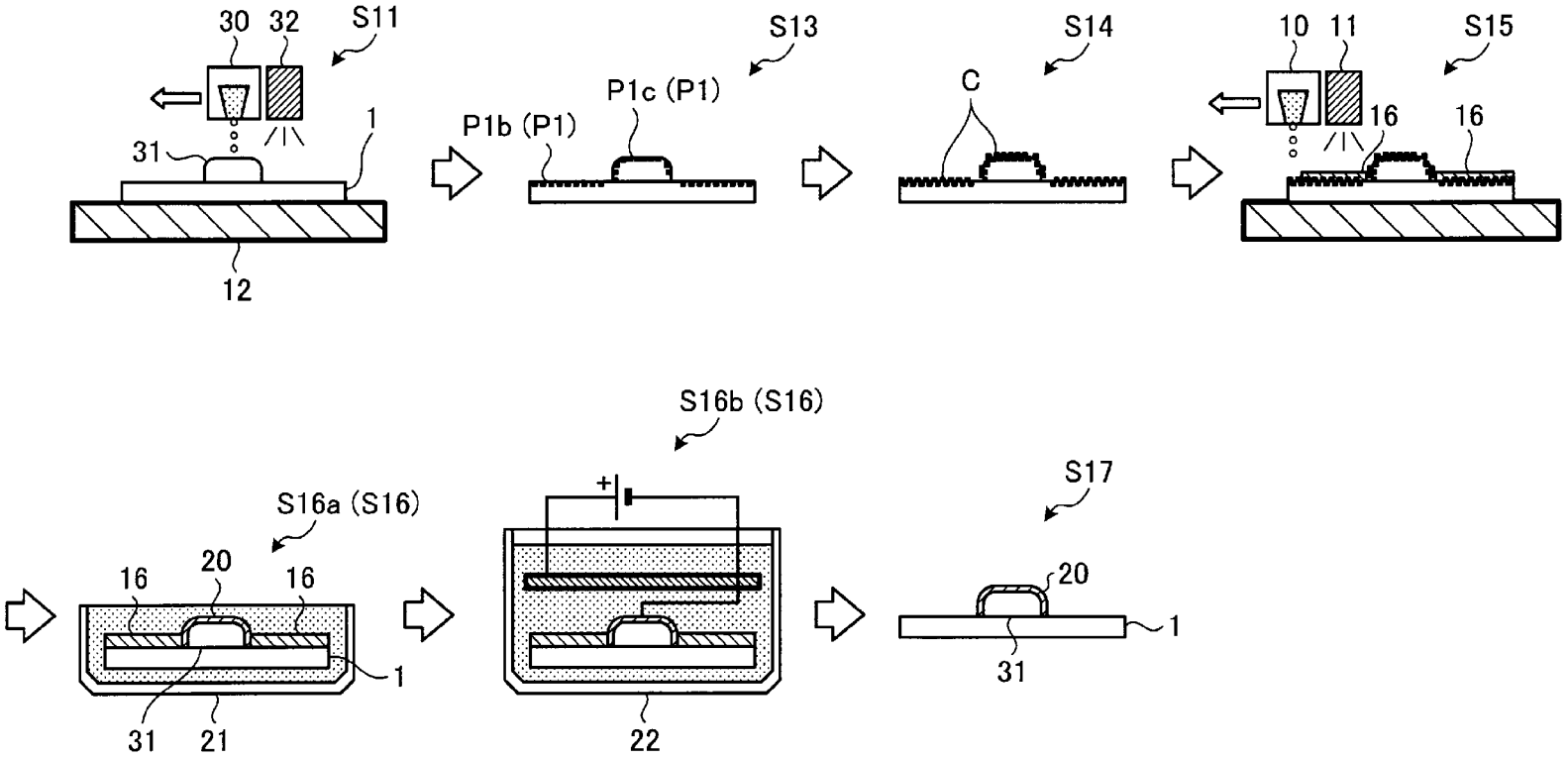
FIG. 6 is a drawing that illustrates the plating method according to the third embodiment.

A plating method according to a third embodiment is hereinafter described referring to FIGS. 5 and 6. The third embodiment describes any technical aspects distinct from the first and second embodiments to avoid redundancy in description, while illustrating elements similar to those of the first embodiment with the same reference signs. FIG. 5 is a flow chart of the plating method according to the third embodiment. FIG. 6 is a drawing that illustrates the plating method according to the third embodiment.

In the plating method according to the third embodiment, the first mask forming step S12 of the plating method according to the second embodiment is omitted, and the second mask forming step S15 of the second embodiment is replaced with a mask forming step S15. The plating method according to the third embodiment, without forming the first plating mask 15 on the plating target object 1, performs the surface roughening treatment and applies the catalyst to the surface P1 of the plating target object 1. In the mask forming step S15, the second plating mask 16 is formed as a plating mask 16 on the surface-roughened and catalyst-applied surface of the plating target object 1.

In the third embodiment, the surface P1*c* of the raised portion 31 and the surface P1*b* of the plating target object 1 on which the raised portion 31 is unformed are roughened in the surface roughening step S13. In the catalyst applying step S14, the catalyst C is applied to the surface P1*c* of the raised portion 31 and the surface P1*b* of the plating target object 1 on which the raised portion 31 is unformed. Any other steps are similar to those of the second embodiment, description of which is, therefore, omitted. As a result of these steps, the raised portion 31 and the plating layer 20 formed on the surface P1*c* of the raised portion 31 remain on the resulting plating target object 1 after the mask removing step S17. The surface P1*b* of the plating target object 1 on which the raised portion 31 is unformed has been subjected to the surface roughening treatment. In the third embodiment that performs the surface roughening step S13, the plating target object 1 on which the raised portion 31 is unformed has a roughened surface P1*b*. On the other hand, the surface P1*b* of the plating target object 1 on which the raised portion 31 is unformed is not roughened in case where the surface roughening step S13 is not performed.

According to the third embodiment, the plating mask 16 is formed on the plating target object 1 to which the catalyst C has been applied, and the catalyst C is coated with the plating mask 16. This may prevent the plating material from depositing on the plating mask 16. Thus, even when in the mask removing step S17, the plating mask 16 are removed by using an organic solvent, the organic solvent may adequately penetrate into the plating mask 16 because formation of the plating layer 20 on the plating mask 16 is preventable as described. This may facilitate adequate removal of the plating mask 16.

What is claimed is:

1. A plating method, comprising:

a first mask forming step of forming a first plating mask on a plating target object, the first plating mask being formed to prevent a catalyst for deposition of plating material from attaching to the plating target object;

a surface roughening step of subjecting the plating target object to a surface roughening treatment, wherein the surface roughening treatment is at least one of etching and sandblasting;

a catalyst applying step of applying the catalyst to the plating target object on which the first plating mask is formed;

a second mask forming step of having ink droplets of a UV-curable ink land on the first plating mask so as to form a second plating mask on the first plating mask;

a plating step of performing electroless plating to the plating target object subsequent to the second mask forming step; and a mask removing step of removing the first plating mask and the second plating mask from the plating target object subsequent to the plating step, wherein an aqueous plating solution is used in the plating step, the first mask forming step is a step of ejecting the UV-curable ink in the form of ink droplets from an inkjet head so as to have the ejected ink droplets land on the plating target object, and the landed UV-curable ink is irradiated with ultraviolet light so as to cure, the UV-curable ink is polymerizable by ultraviolet irradiation into a UV-curable resin, and the UV-curable ink is aqueous solution-insoluble and organic solvent-soluble after curing.

2. A plating method, comprising:

a surface roughening step of subjecting a plating target object to a surface roughening treatment, wherein the surface roughening treatment is at least one of etching and sandblasting;

a catalyst applying step of applying a catalyst for deposition of plating material to the plating target object;

a mask forming step of ejecting a UV-curable ink in the form of ink droplets from an inkjet head so as to have the ejected ink droplets land on the plating target object and to form a plating mask on the plating target object;

a plating step of performing plating to the plating target object subsequent to the mask forming step; and a mask removing step of removing the plating mask from the plating target object subsequent to the plating step, wherein an aqueous plating solution is used in the plating step, the UV-curable ink is a UV-curable and solvent-soluble ink, the UV-curable and solvent-soluble ink comprising:

a UV-curable compound polymerizable by ultraviolet irradiation into a UV-curable resin; and a solvent-soluble material soluble in a solvent, and the UV-curable ink is aqueous solution-insoluble and organic solvent-soluble after curing.

3. The plating method according to claim 1, wherein the UV-curable ink further comprises an organic solvent having compatibility with the UV-curable compound.

4. The plating method according to claim 1, wherein the catalyst applying step is a wet process, and the plating step is a wet process.

5. The plating method according to claim 2, wherein the UV-curable ink further comprises an organic solvent having compatibility with the UV-curable compound.

6. The plating method according to claim 2, wherein the catalyst applying step is a wet process, and the plating step is a wet process.

* * * * *